US006244005B1

(12) United States Patent
Wallin

(10) Patent No.: US 6,244,005 B1
(45) Date of Patent: Jun. 12, 2001

(54) MODULAR WALL SYSTEM

(76) Inventor: Arne B. Wallin, 1912 South Orr Lake Road, Elmvale, Ontario (CA), L0L 1P0

( * ) Notice: Subject to any disclaimer, the term of this patent is extended or adjusted under 35 U.S.C. 154(b) by 0 days.

(21) Appl. No.: 09/241,305

(22) Filed: Feb. 1, 1999

Related U.S. Application Data

(63) Continuation-in-part of application No. 08/980,365, filed on Nov. 28, 1997, now Pat. No. 5,864,999.

(51) Int. Cl.[7] ..... E02D 27/00

(52) U.S. Cl. ..... 52/293.1; 52/250; 52/293.3; 52/169.9; 52/742.1; 249/19; 249/22; 249/34

(58) Field of Search ..... 52/250, 251, 258, 52/292, 293.1, 293.3, 294, 295, 274, 602, 169.9, 745.05, 745.1, 742.1, 741.13; 249/19, 22, 26, 28, 31, 33, 34, 35

(56) References Cited

U.S. PATENT DOCUMENTS

| | | | | |
|---|---|---|---|---|
| 996,262 | * | 6/1911 | Kurtz | 52/293.1 X |
| 1,289,083 | * | 12/1918 | Banks | 249/33 |
| 1,834,892 | * | 12/1931 | Betzler | 52/293.1 X |
| 2,200,636 | * | 5/1940 | Palmer | 52/293.1 |
| 2,270,846 | * | 1/1942 | Hines | 52/250 X |
| 2,350,018 | * | 5/1944 | Dean et al. | 52/250 X |
| 3,884,444 | * | 5/1975 | Dashew | 249/35 X |
| 4,090,266 | | 5/1978 | Price | 52/172.19 |
| 4,186,160 | * | 1/1980 | Landreth | 52/293 |
| 4,512,126 | * | 4/1985 | Walston | 52/251 |
| 4,823,534 | * | 4/1989 | Hebinck | 52/251 |
| 4,903,450 | | 2/1990 | Adams | 52/293 |
| 5,028,364 | * | 7/1991 | Lee | 249/31 |
| 5,074,517 | * | 12/1991 | Scott | 249/35 X |
| 5,111,628 | * | 5/1992 | Desjoyaux et al. | 249/33 |
| 5,588,786 | * | 12/1996 | House et al. | 52/741.15 X |

FOREIGN PATENT DOCUMENTS

| | | |
|---|---|---|
| 2406049 | 11/1979 | (FR) . |
| 2700353 | 7/1994 | (FR) . |

* cited by examiner

*Primary Examiner*—Carl D. Friedman
*Assistant Examiner*—Winnie Yip
(74) *Attorney, Agent, or Firm*—David J. French

(57) ABSTRACT

A precast wall panel has forms for flanges and a lintel embedded in place. Upon erection of the panel over a precast footing having an anchoring trough, this trough, the flanges and lintel may all be cast on-site, with appropriate reinforcing present within the core volumes that are filled with binder.

12 Claims, 8 Drawing Sheets

MODULAR WALL SYSTEM

This application is a Continuation-In-Part of application Ser. No. 08/980,365 filed Nov. 28, 1997 and issued as U.S. Pat. No. 5,864,999 on Feb. 2, 1999.

FIELD OF THE INVENTION

This invention relates to the construction industry. More particularly it addresses a modular wall system based upon precast concrete panels and accessory elements that may be erected on a site to provide a concrete wall suitable for a building.

BACKGROUND TO THE INVENTION

Construction techniques based upon the use of precast panels for forming walls are known. This includes panels which are tipped-up for positioning on a foundation and then fastened together by various means.

A number of prior art references that describe precast concrete wall panels are referred-to in U.S. Pat. No. 5,864,999, the contents of which are adopted herein by reference. None of those references, nor the prior art cited with respect to U.S. Pat. No. 5,864,999, show a precast wall panel with rearwardly extending flange portions having reinforcing members protruding for embedment in a linear footing member having a U-shaped trough filled with concrete grout.

The aforesaid invention presupposes that the flanges on the precast panel are precast with the panel, or are precast to be fitted to the panel at the job site. The present invention is premised on the formation of such flanges at the job site, rather than by precasting in advance.

As a further feature of the prior invention the flanged wall panels may be surmounted by a precast lintel having a grout-receiving trough and pierced openings to permit reinforcing members to extend upwardly from the flanges through the lintel bottom for embedment in the grout or anchoring filler. The present invention is based upon casting the lintel pieces on-site.

A need exists for an improved system for supporting and fastening precast wall panels in position. This invention addresses such a need by providing a modular wall structure that can quickly be erected on a job site providing a full load-bearing and weather-tight wall.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

According to one aspect of the invention, a precast construction member has a form bonded thereto that contains an open interior for subsequent filling with a binder material such as concrete. This form, when applied to a flat panel suited for use as a wall element can be shaped in a longitudinal format that will produce a flange on the panel, once the open hollow interior of the form is filled with the binder material.

By a further feature, the form may provide an open, horizontal trough-like volume along a surface of the construction member which volume is filled with binder to provide a stiffening support to the member. In the case of a wall panel, a lintel can be cast along its upper edge.

The invention in another aspect is directed to a modular wall system comprising:

(a) a wall panel having a wall portion and a form mounted thereon for casting a outwardly extending flanged portion;

(b) a footing member having a footing trough defined by first and second trough sidewalls positioned beneath and supporting said wall panel; and (c) lower coupling means protruding downwardly from the lower ends of each of the forms of the flanged portions of said panels;

wherein the wall portion of each of said wall panel is dimensioned to be placed to extend along the top of the first of the trough side walls of said footing trough, with the form for casting the flanged portion of the wall panel extending outwardly from said panel across the footing trough in order to subsequently support said wall panel when erected in an upright position and when the lower coupling means is imbedded in a binder or grout such as concrete within the footing trough when the form for casting the flange and the footing trough are filled with binder.

Preferably, the form for the flange is of sheet material, e.g. galvanized steel or plastic which is fastened, as by embedment, to the precast wall panel. To improve coupling between this form and the binder with which it is eventually to be filled, portions of the wall of the form may be depressed or deformed inwardly to provide dimples or tabs to be embedded within the binder when the binder is poured into the form.

The lower coupling means may consist of reinforcing bar that protrudes upwardly into the interior volume sufficiently to ensure that it is properly anchored therein when the form is filled with binder. Such reinforcing bar is preferably tied or hooked at its lower end to a similar bar laid in the footing trough before it is filled with binder. Once the form and footing trough are filled with binder, the wall panel will be anchored in place.

By a further feature of the invention a lintel member may be provided for positioning along the tops of said panel member, overlying the wall and flanged portions, the lintel member having a lintel trough formed therein with perforations formed along the lower surface of the lintel trough. Upper coupling means may then protrude upwardly from the upper ends of each of the panels, preferably from the forms for the flanged portions, for penetration into the lintel trough through the perforations. Such upper coupling means are then imbedded in a grout or binder, such as concrete, when the lintel trough is filled with binder.

Optionally, a panel may have a second or more longitudinal form for casting second or additional flanged portions positioned for overlying the footing trough when the panel is erected into an upright position. This provides a panel of multiples of "F"-shaped cross-section.

Instead of providing a precast lintel, the precast panel of the invention may have a second form, a lintel form, attached near or along the upper face portion of the panel. This lintel form may be of sheet metal that is coupled to the panel, as by being embedded therein along its lower edge. This lintel form then extends upwardly and outwardly between the flange forms to provide a receiving trough to support binder, such as concrete. In this manner a cast-in-place lintel may be created spanning the top of the precast panel.

Again, for strength, reinforcing bar may be used as the upper coupling means, such bar extending up into the interior volume of the lintel from the core of the flange forms. This upper coupling means is then anchored in place when the lintel trough and flange form are both filled with binder.

As with the lower coupling means, the upper coupling means preferably engages with horizontal lintel reinforcing imbedded within the binder being used to fill the lintel trough. The reinforcing, such as steel bars, present within such troughs ideally extends between adjacently located footings and/or lintel members.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 2:
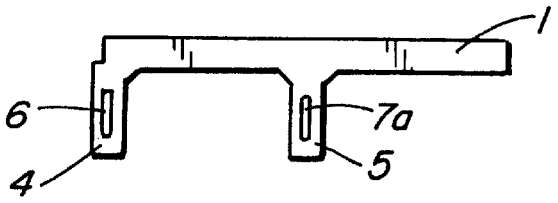
FIG. 2 is an end view of FIG. 1.
Figure 1:
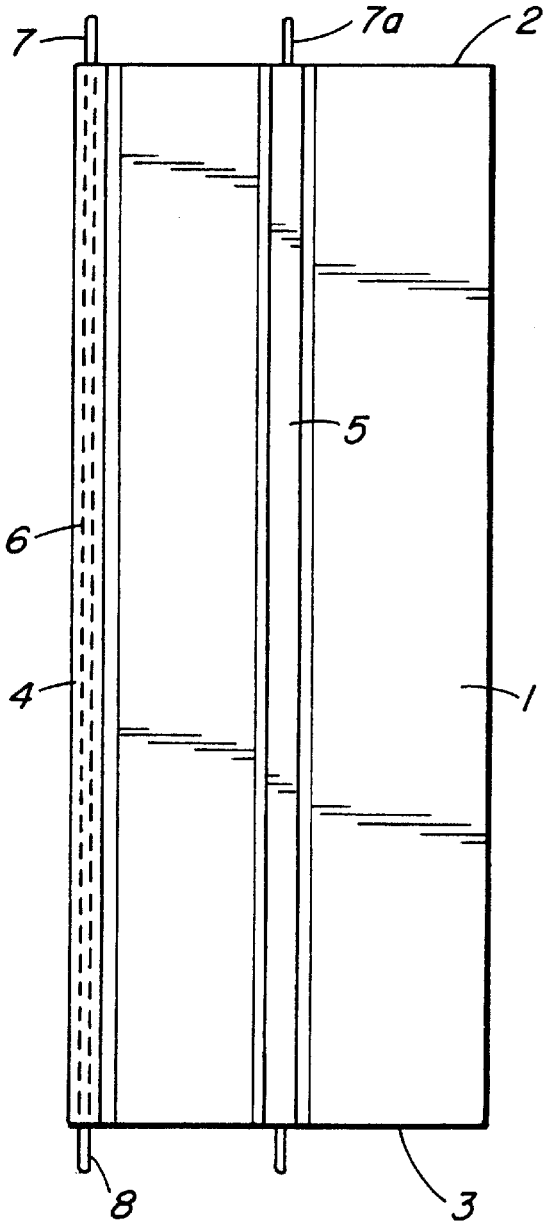
FIG. 1 is a face view of a wall panel with two protruding flanged leg portions.
Figure 3:
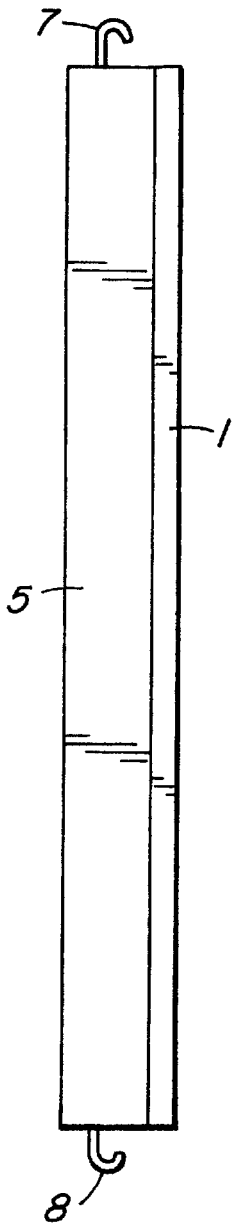
FIG. 3 is a plan view of FIG. 1.

In FIGS. 1, 2 and 3 a wall panel 1 of the prior U.S. Pat. No. 5,864,999 is shown having upper 2 and lower 3 ends and a principle 4 and optional secondary 5 leg panel positioned to form an "F" cross-section. Without the secondary leg panel 5, an "L" cross-section is formed. The wall panel, and principle leg panel 4 may be integrally formed, preferably by casting or by extrusion. The material for these components may be a cementatious substance such as concrete, or an equivalent material. While shown as a unitary combination in FIGS. 1, 2 and 3, these parts may be separately formed for subsequent inter-connection.

Imbedded within the principle leg panel 4 is shown a reinforcing bar 6 that protrudes from the top and bottom ends of the principle and secondary leg panels 4 and 5. The upper and lower protruding portions 7 and 8 respectively are hooked to serve as coupling means to engage with concrete, grout or other cementations material, and optionally reinforcing bars as further described below.

The protruding portions 7 and 8 serve as coupling means to couple the wall and leg panels to a footing 9 and lintel 10 shown in FIGS. 7–9 and 4–6 respectively.

Figure 7:
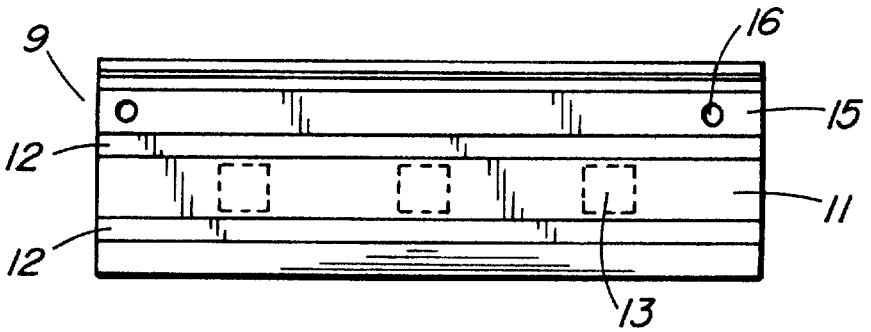
FIG. 7 is a plan view of a footing member for supporting wall panels.
Figure 9:
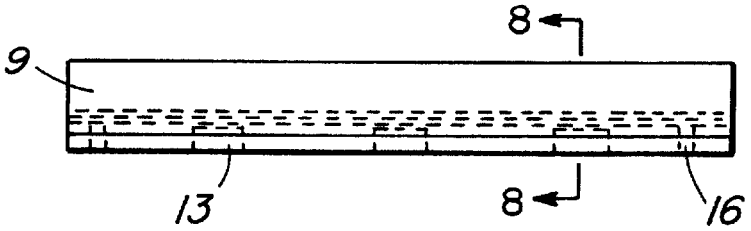
FIG. 9 is an end view of FIG. 8.
Figure 8:
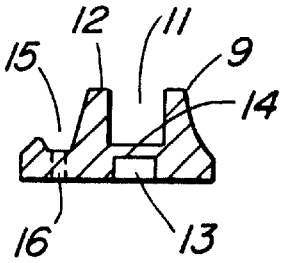
FIG. 8 is a front view of FIG. 7.

In FIGS. 7–9 a footing member 9 is of extended length is provided with a trough 11 and trough sidewalls 12. Optional pockets 13 leave knock-out portions 14 in the bottom of each footing trough 11 to assist in stabilizing the footing. A secondary drainage trough 15 may optionally be provided along side the footing member 9 preferably integrally formed as by casting. Drainage holes 16 may intermittently perforate the bottom of the drainage trough 15.

Figure 4:
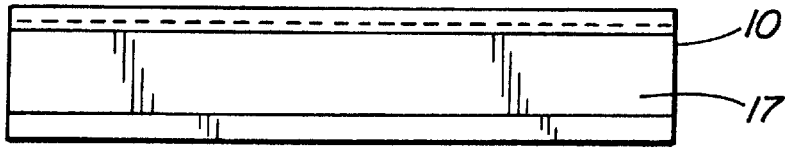
FIG. 4 is a plan view of a lintel for overlying wall panels.
Figure 5:
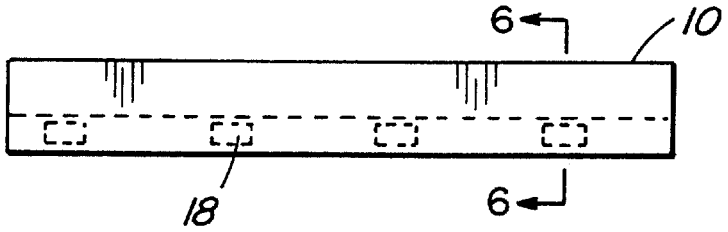
FIG. 5 is a face view of FIG. 4.
Figure 6:
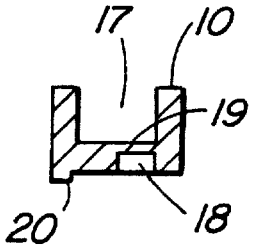
FIG. 6 is a cross-sectional end view of FIG. 5.

In FIGS. 4, 5 and 6 a lintel 10 is provided with a lintel trough 17 and pockets 18 to provide knock-out portions 19 in the bottom of the lintel trough 17. The lintel 10 is of a width to span the wall panel 1 and principle leg panel 4. It may optionally have a flanged overhang 20 that will overhang the upper end 2 of the wall panel 1.

Figure 11:
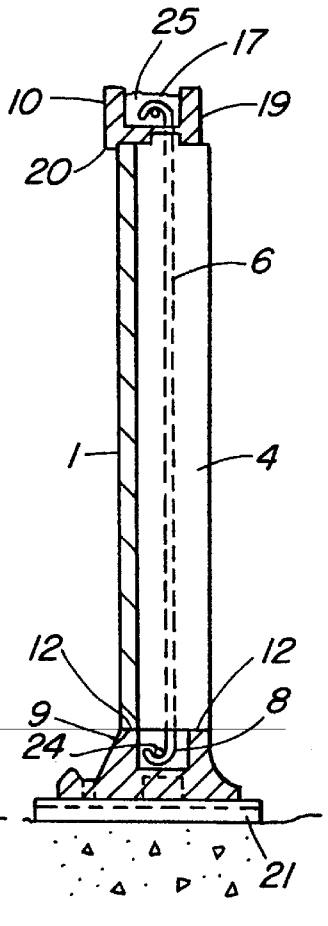
FIG. 11 is an edge view of FIG. 10.
Figure 10:
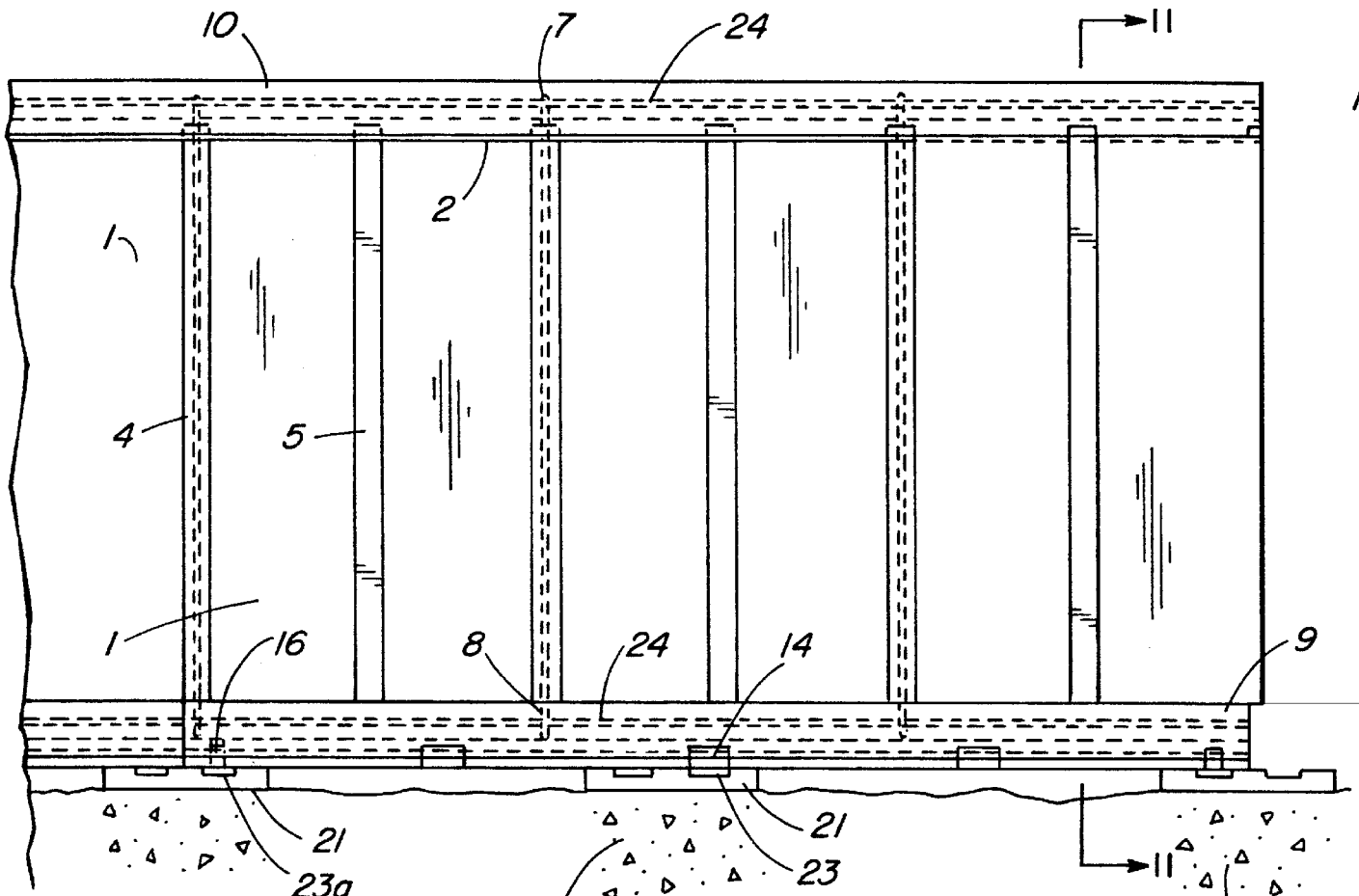
FIG. 10 is a face view of an assembled wall system incorporating wall panels, footing members and lintel components.
Figure 13:
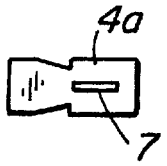
FIG. 13 is a top view of FIG. 12.
Figure 14:
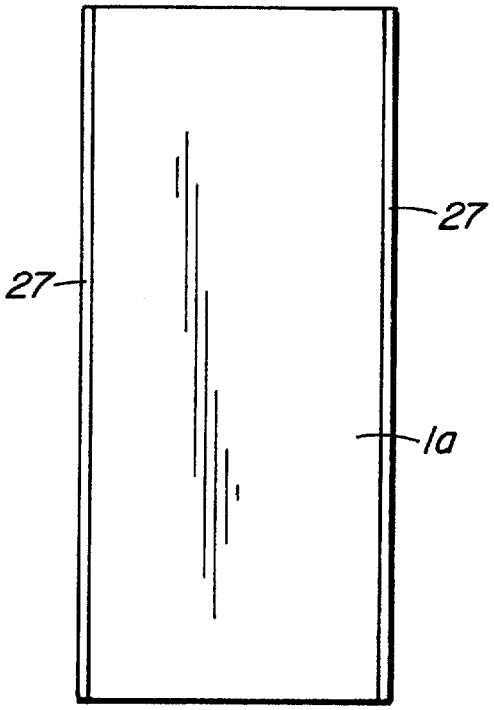
FIG. 14 is a face view of an alternate wall panel that interfits with the leg panel of FIG. 12.

The assembled wall system shown in FIGS. 10 and 11 provides for footing pads 21 position an consolidated ground, e.g. containing aggregate 22 at intervals. The pads 21 have recesses 23 to contain grout extending through the footing trough knock-out portions 14 to stabilize the footing 9 on the pads 21.

Optionally, some pads may have recesses 23 that are transverse grooves 23*a* which are aligned with the drainage holes 16 in the drainage trough 15. This provides a means for drainage water to be lead away from the footings.

The wall panels 1 are positioned along one trough sidewall 12 and the leg panel 4 extends transversely across the footing member 9, spanning two trough sidewalls 12. The lower coupling means 8 is preferably hooked to engage with reinforcing means, such as a reinforcing bar 24 that is imbedded in a cementations materials, such as concrete or mortar, that is placed in the footing trough 11. When two footing members 9 abut, these reinforcing bars 24 extend between adjacent sections, anchoring them together. Further such bars 24 may be fastened intermittently to the trough bottom between leg panels 5.

Along upper ends 2 of the panels 1 the lintel 10 is positioned with the optional overhang 20 aligned with the upper edges of each panel. The upper coupling means 7 protrude through the opened knock-out portions 19 into the lintel trough 17 to engage with reinforcing means, e.g. reinforcing bars 24 and to be embedded in a cementatious filling 25.

If optional secondary leg panels 5 are present they may also optionally be provided with anchor means 7*a* which are similarly imbedded and anchored.

Figure 12:
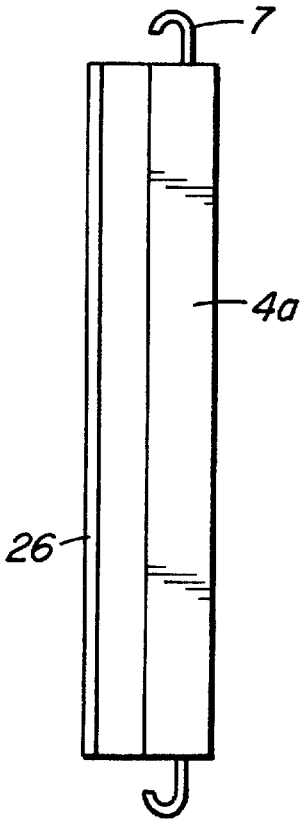
FIG. 12 is a face view of a separate leg panel.
Figure 15:
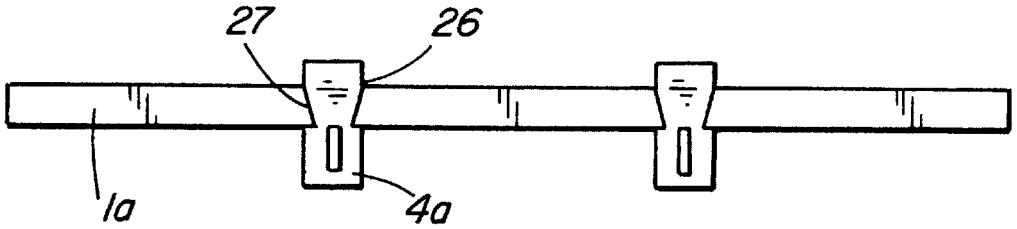
FIG. 15 is an assembly plan view of the wall and leg panels of FIG. 14 and 12.

While the wall and principle leg panels 1 and 4 of FIG. 2 are shown as being integrally formed, FIGS. 12–15 show an optional system wherein these elements are formed separately. In FIG. 12 a leg panel 4*a* has a dove-tailed edge 26. The separate wall panels 1*a* have bevelled outer edges 27. When assembled as shown in FIG. 15, these bevelled edges 27 interfit on the respective sides of the dove-tailed edges 26 of each leg panel 4*a*. The presence of the overhang 20 in this variant helps maintain the wall panels 1*a* in position.

Figure 16:
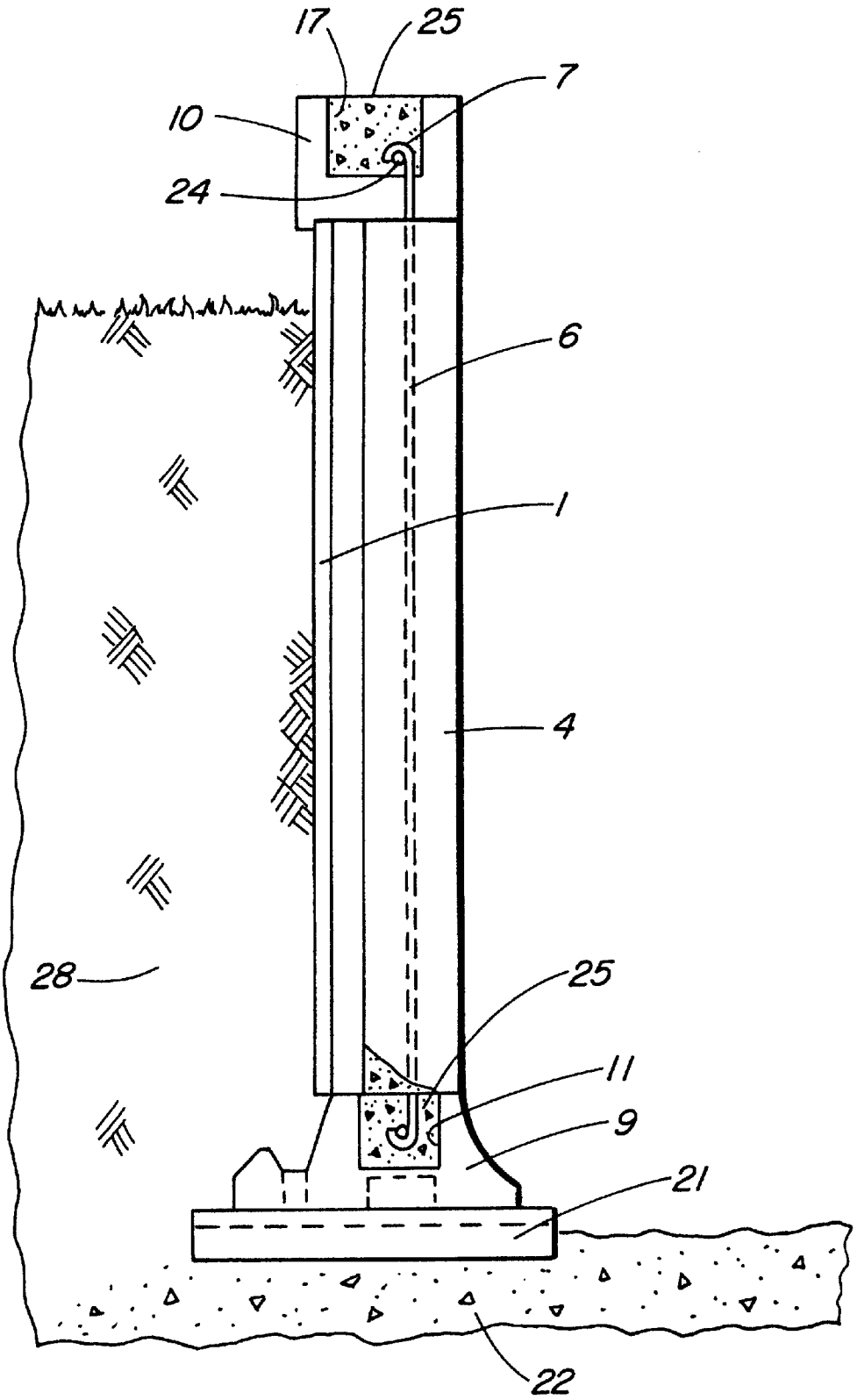
FIG. 16 is a cross-sectional view similar to FIG. 11 with back-fill present against the wall panel 1.
Figure 18:
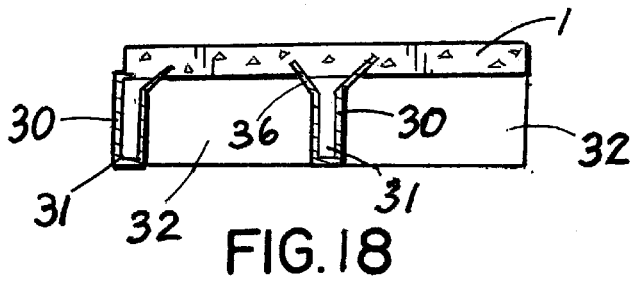
FIG. 18 is an upwardly directed, cross-sectional end view of the panel FIG. 17.

A further cross-sectional view of the assembled wall in FIG. 16 shows the components in place and back-fill 27 present against the buried wall panel 1.

Figure 17:
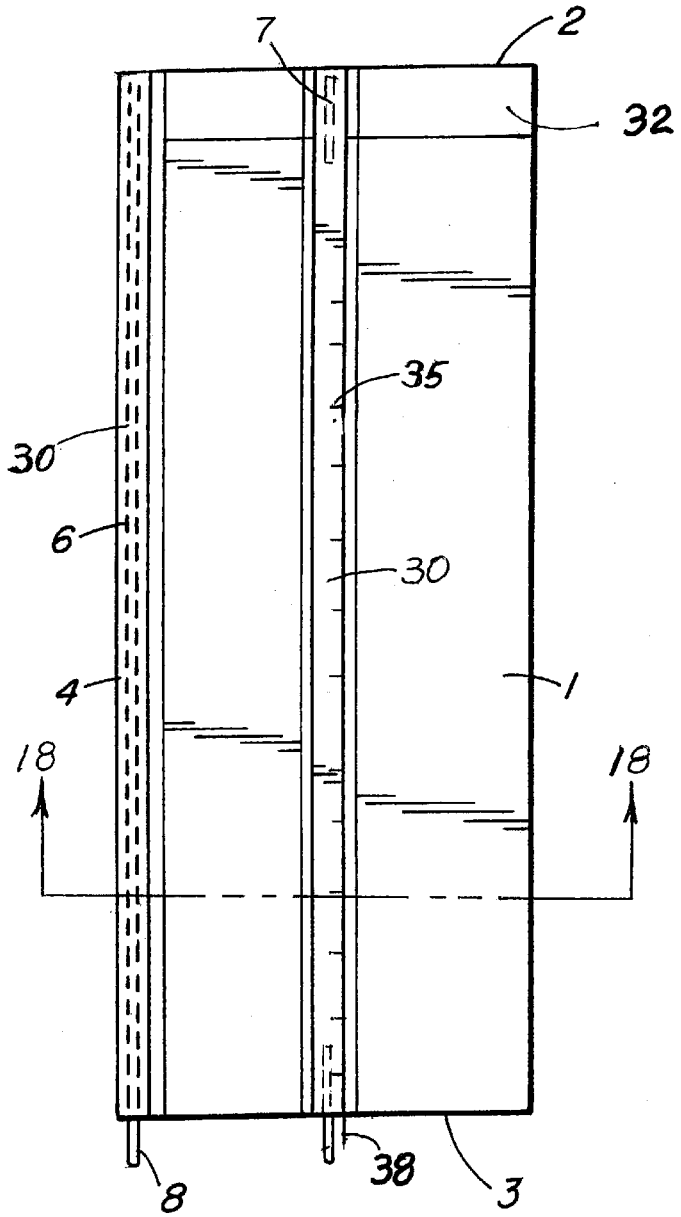
FIG. 17 is a side view of the panel with lintel trough and flange forms, according to the invention.
Figure 19:
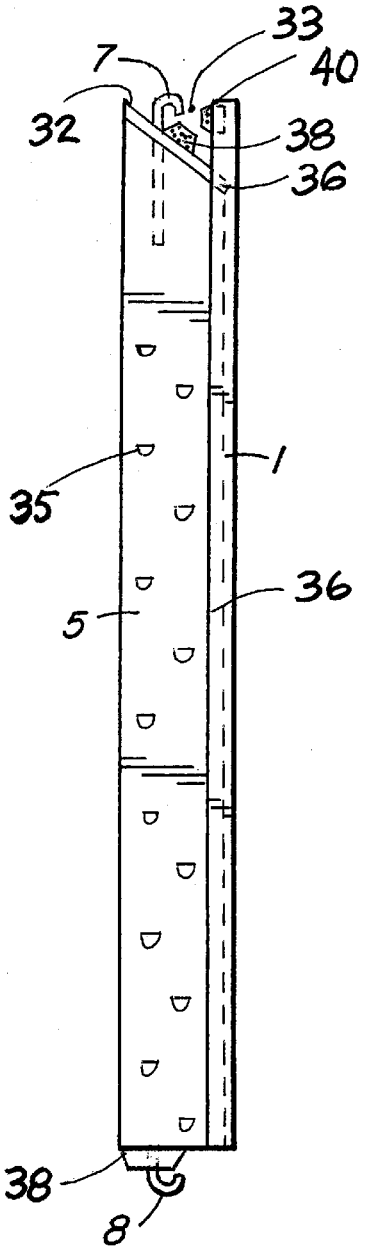
FIG. 19 is a side edge view of the panel of FIG. 17.
Figure 20:
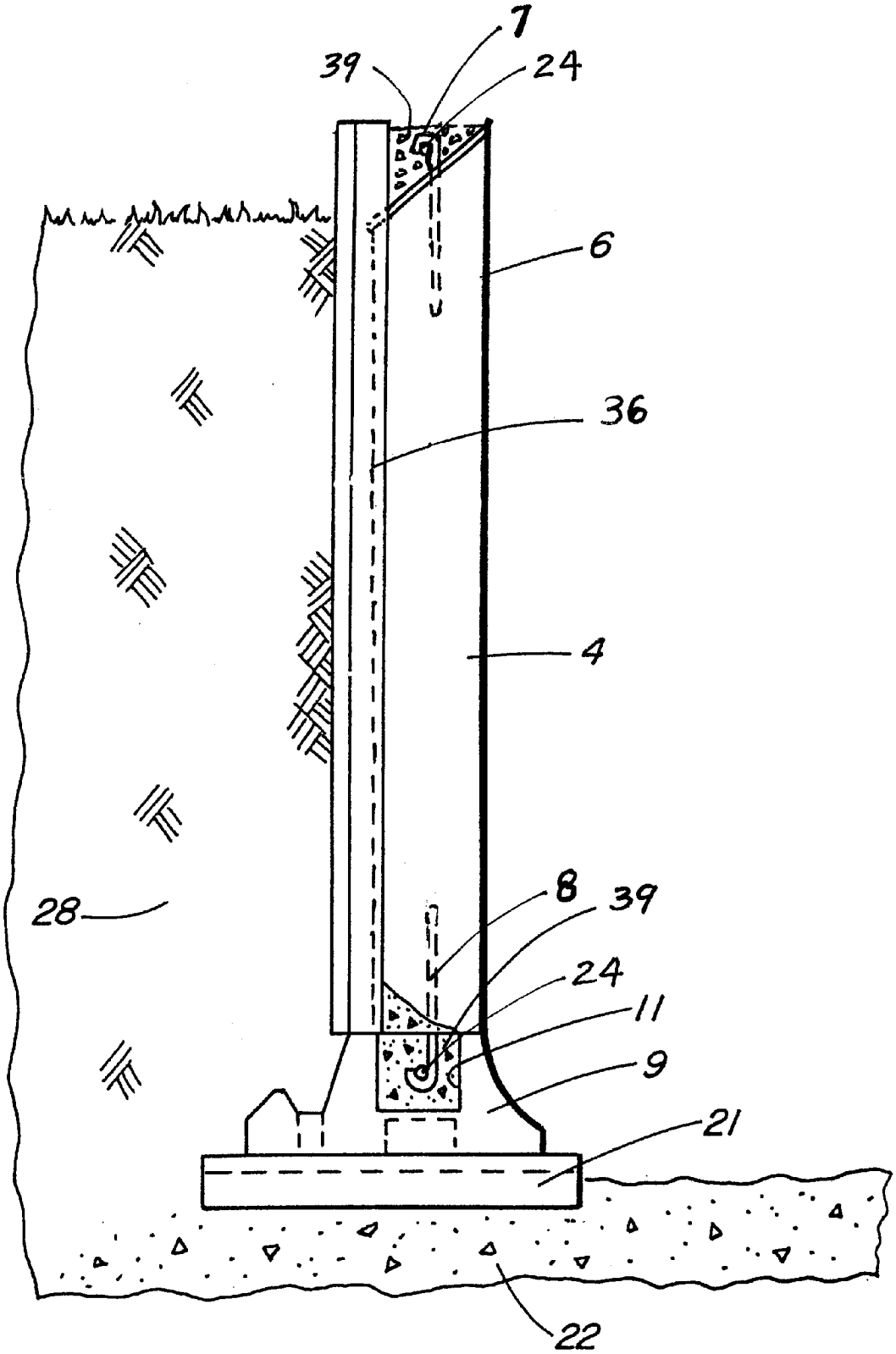
FIG. 20 is a partially cut away side view of the panel of FIG. 17 installed on the footing of FIG. 8 with grout/filler in place in the lintel, flange and footing volumes.

In FIG. 17, a panel with the flange form 30 according to the invention is shown. This variant of the form 30 is a sheet material, such as galvanized sheet steel, bent to a "U"-shaped cross-section with the legs 36 of the "U" embedded in the panel 1 at the time of casting the panel 1. The form 30 has a hollow core 31.

A lintel trough form 32 is also cast into the panel 1, spanning between the forms 30. The interior 31 of the forms 30 communicate with the volume 33 of the trough formed by the lintel trough form.

On assembly, reinforcing bars 7, 8 which serve as upper and lower coupling means may be inserted into the flange interior volumes cores 31, protruding to respectively lie within the lintel trough volume 33 and footing trough 11. Lintel and footing horizontal reinforcing bars 24 lie in these respective troughs and are tied to the reinforcing coupling bars 7, 8. In lieu of using bar 8 inserted into the flange interior 31, a portion 38 of the flange form 30 itself may protrude for embedment in grout or cement serving as binder material in the lintel and footing. Alternately, an anchoring plate may be bolted to the form 30 to protrude in a similar manner. thus coupling the binder material in the flange core volumes 31 to binder material in the footing trough 11.

To couple the wall panel 1 more securely to the lintel to be formed in the trough 33, reinforcing 40 may be embedded in the wall 1 next to the trough interior 33. This may be in the shape of expanded metal plates 40 located at intervals along the top portion of the panel 1 preferably intermediate the forms 30.

The walls of the flange forms 30 may have bent tabs 35 punched inwardly into the flange core 31. These tabs 35 become embedded in the grout or mortar 39 used as binder when the flange cores 30 and lintel trough volumes 33 are filled. This increases the coupling between the form 30 and the binding filler 39, increasing their composite strength.

Figure 21:
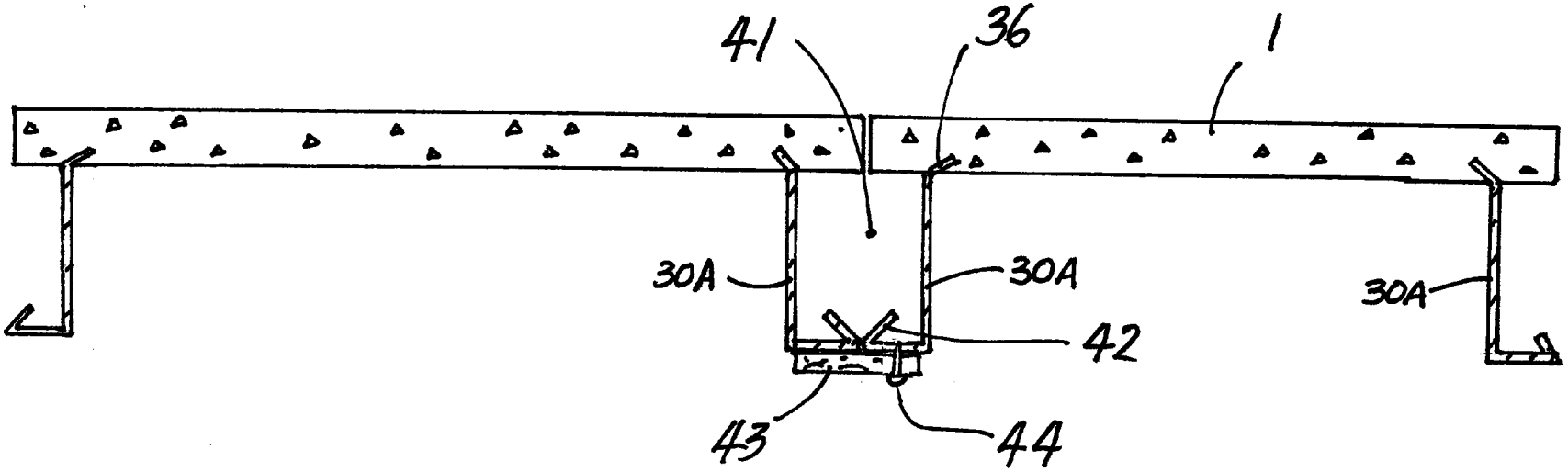
FIG. 21 is a cross-sectional end view of a panel variant on FIG. 18.

In FIG. 21 an alternate format of form 30A are mounted along the edges of the panels 1 so that, when the panels 1 are abutted, a closed volume 41 is created. The half-forms 30A have panel-embedded edges 36 as in the other embodiments. The opposite longitudinal edge of the half-form 30A has an inwardly-bent, free-end flange 42. The free-end flanges 42 of abutting forms 30A will become embedded in the filler to be placed in the interior volume 41 of the combined forms 30A.

To hold the half forms 30A in place together while the binder (not shown) is being pored, a wooden nailer strip 43 is attached to the inner faces of the adjacent half-forms 30A. This strip 43 can be attached on-site to the half-forms 30A once the panels are in place by means of sheet metal screws 44. Such strips 43 may alternately be pre-attached to one of the form 30A for convenience of delivery and eventual assembly.

By providing half-forms 30A at the edges of each panel 1, the filler serves to seal and stabilize the joint between the two panels 1.

By casting the flanges and lintel on site, the cost of prefabricated castings is reduced. As some concrete is required on site to fill the troughs, the additional concrete needed to cast the flanges and lintel is not burdensome. Because key parts are precast and contain cast-in-place forms, no forms need be created on-site. Further, by being fastened to precast panels, the forms are precisely placed in the exact locations where flanges and the lintel should be eventually installed. This greatly facilitates the erection process.

Conclusion

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property are claimed as follows:

1. A modular wall system comprising:

(a) a wall panel having a wall portion and a flange form mounted thereon for providing an interior, flange form volume for casting an outwardly extending, flanged portion onto said panel;

(b) a footing member having a footing trough defined by first and second trough sidewalls, the footing member being positioned beneath and supporting said panel;

(c) binder material contained within the flange form volume and located within the footing trough; and (d) lower coupling means extending between the binder material within the flange form volume and the binder material located within the footing trough, wherein the wall portion of said wall panel extends along said footing member, the flange form extends outwardly from said panel across the footing trough to provide support for said wall panel when erected in an upright position with the flange form volume and the footing trough filled with binder material and with said lower coupling means embedded in the binder material present in said trough.

2. A wall system as in claim 1 wherein the flange form is of sheet metal which is fastened to the wall panel by the embedding of portions of the sheet metal within the wall portion of the wall panel.

3. A wall system as in claim 2 wherein portions of the outer surface of the flange form are depressed inwardly into the flange form volume to be embedded within the binder contained therein.

4. A wall system as in claim 1 including a footing reinforcing bar laid in the footing trough and embedded within the binder material present therein and wherein the lower coupling means is connected to the footing reinforcing bar.

5. A wall system as in claim 1 further comprising a plurality of said adjacent wall panels wherein said flange forms which are mounted respectively on each of said wall panels are complementary half-forms which are mounted along panel side edges so as to encloses when coupled together, said interior flange form volume.

6. A wall system as in claim 1 wherein said panel has two or more of said flange forms and further comprising a lintel form of sheet material coupled to the panel and extending upwardly and outwardly between the flange forms to provide a lintel trough containing binder material and forming a lintel spanning across the upper portion of the panel.

7. A wall system as in claim 6 comprising upper coupling means which extends from the flange form volume into the volume of the lintel trough to be anchored in place by the binder material present therein.

8. A wall system as in claim 7 comprising lintel reinforcing means imbedded within the binder present within the lintel trough, said lintel reinforcing means being connected to the upper coupling means.

9. A wall system as in claim 1 further comprising a binder-filled lintel-forming member positioned along the top portion of said wall panel, overlying at least in part said flange form, the lintel-forming member defining a lintel trough, there being at least one perforation formed through the lintel-forming member along the lower surface of said trough in register with the flange form volume, said system further comprising upper coupling means extending between binder material present in the flange form volume and binder material present in the lintel trough and embedded therein.

10. A modular wall system comprising:

(a) a plurality of wall panels placed adjacent to each other, each having a wall portion with side edges and a flange form mounted thereon for providing a flange form volume for casting an outwardly extending, flanged portion onto each of said panels;

(b) a footing member having a footing trough defined by first and second trough sidewalls, the footing member being positioned beneath and supporting said panels;

(c) binder material contained within the flange form volumes and located within the footing trough; and (d) coupling means extending between the binder material within each of said flange form volumes and the binding material located within the footing trough, wherein the wall portion of each of said wall panels extends along said footing member, said flange forms extend outwardly from said panels across the footing trough to provide support for said wall panels when erected in an upright position with the flange form volumes and the footing trough filled with binder material and with said coupling means embedded in the binder material present in said trough, wherein said flange forms are mounted respectively along the side edges of adjacent wall panels and said flange forms are complementary half-forms which, when coupled together, provide said flange form volume.

11. A construction member having a wall portion and a pair of side edges on either side of said wall portion, said member comprising a pair of complementary half-forms respectively positioned along said edges to provide, when a pair of said panels are placed adjacent to each other with said half-forms meeting, a volume for subsequent filling with a binder material to produce a flange for said construction members, wherein said half forms are of sheet metal, a portion of each of said half forms being embedded in said wall portion.

12. A construction member as in claim 11 wherein portions of the outer surface of the flange forms are depressed inwardly to be embedded within binder to be contained therein.

* * * * *